United States Patent [19]

Hauff et al.

[11] 4,233,972

[45] Nov. 18, 1980

[54] PORTABLE AIR FILTERING AND BREATHING ASSIST DEVICE

[76] Inventors: Wolfgang Hauff, 235 Keith Rd., West Vancouver, B.C., Canada; John W. Tidland, 2084 SW. Linnell, Roseburg, Oreg. 97470

[21] Appl. No.: 903,925

[22] Filed: May 8, 1978

Related U.S. Application Data

[63] Continuation-in-part of Ser. No. 801,655, May 31, 1977, abandoned.

[51] Int. Cl.[3] ..... A62B 7/10

[52] U.S. Cl. ..... 128/205.12; 128/205.25; 128/912

[58] Field of Search ..... 128/142 R, 141 R, 142.3, 128/142.4, 142.5, 142.6, 142.7, 146, 146.3, 146.4, 146.5, 146.6, 146.7, 147, 205.12, 205.25, 206.17, 206.12, 912

[56] References Cited

U.S. PATENT DOCUMENTS

| | | | |
|---|---|---|---|
| 1,050,718 | 1/1913 | Brewster | 128/146.6 X |
| 2,100,374 | 11/1937 | Biever | 128/142.6 |
| 2,332,662 | 10/1943 | Nathanson | 128/142.3 |
| 2,642,061 | 6/1953 | Boyer | 128/146.6 |
| 2,744,525 | 5/1956 | Whipple | 128/146.6 X |
| 2,818,066 | 12/1957 | Glidden | 128/142.3 |
| 3,657,740 | 4/1972 | Cialone | 128/142.7 X |
| 4,127,122 | 11/1978 | Kienhofer | 128/142.6 X |

FOREIGN PATENT DOCUMENTS

| | | | |
|---|---|---|---|
| 1146758 | 4/1963 | Fed. Rep. of Germany | 128/142.6 |

*Primary Examiner*—Henry J. Recla
*Attorney, Agent, or Firm*—Eugene M. Eckelman

[57] ABSTRACT

A battery operated filter blower unit is arranged to be supported on the person and has connection by a flexible conduit to face pieces such as masks worn by the person, thus allowing a person wearing the filtering device to move about freely. The filter blower unit has universal use with substantially all face pieces. For example, it can be used with a safety mask arranged to be removably supported on a head band having a front opening which is substantially perpendicular to the safety mask whereby ejected air diffuses in all directions against the mask to prevent polluted air from being drawn in around the mask. The mask preferably is turned rearwardly at the sides as well as at the top and bottom to provide a good diffusion of air. The filter blower unit has universal use in that it can be connected to respirator face masks of conventional use or to oxygen type face masks also of conventional use. The filter arrangement in the blower unit is such that conventional respirator face mask filters and holders can be used.

2 Claims, 7 Drawing Figures

PORTABLE AIR FILTERING AND BREATHING ASSIST DEVICE

CROSS REFERENCE TO RELATED APPLICATIONS

This application is a continuation-in-part of application Ser. No. 801,655, filed May 31, 1977 now abandoned.

BACKGROUND OF THE INVENTION

This invention relates to new and useful improvements in portable air filtering devices for face pieces such as masks.

Masks with forced air means have heretofore been employed to furnish filtered air to a user to protect the user from outside polluted air. Such devices for example are shown in U.S. Pat. Nos. 3,112,745 and 3,467,965. Apparatuses such as shown in these patents as well as other patents have inherent disadvantages one of which is that the ventilating protective devices are complex in construction and bulky to wear. This is especially so for apparatus of this type which is worn as complete head covers or hoods. Another disadvantage of prior apparatuses is that a single portable filtering unit cannot conveniently be adapted for use with other types of face masks, thus limiting the device to a particular use. The above disadvantages also make the prior devices costly to manufacture and uneconomical to market.

SUMMARY OF THE INVENTION

According to the present invention and forming a primary objective thereof, a portable air filtering device is provided which overcomes disadvantages of prior devices and in general comprises a simplified, efficient lightweight and versatile structure. One feature of the invention is that a filter blower unit has universal application to most types of face masks. In one application, a head band which can be used with the filter blower unit has air outlet means in the front thereof and such head band is arranged for use with a mask of a structure providing a selected diffusion of air such that no outside polluted air is admitted even though the mask has spaces between it and the user's head. The head band has means for detachably supporting various types of safety masks or shields so that a single head band can be used with various types of masks or shields to suit the condition at hand. In other applications, the filter blower unit can be used with a respirator face mask or with an oxygen mask.

The invention will be better understood and additional objects and advantages will become apparent from the following description taken in connection with the accompanying drawings which illustrate a preferred form of the device.

DETAILED DESCRIPTION OF PREFERRED EMBODIMENTS

Figure 2:
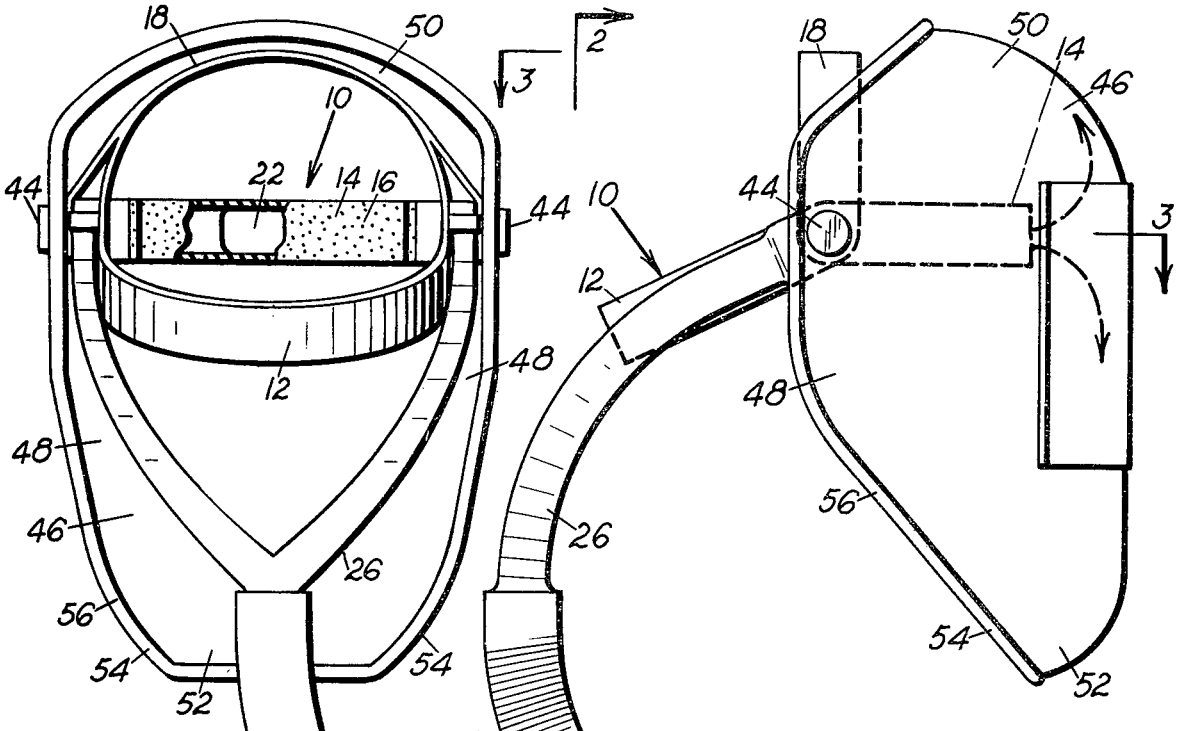
FIG. 2 is a rear elevational view of the invention taken on the line 2—2 of FIG. 1.
Figure 1:
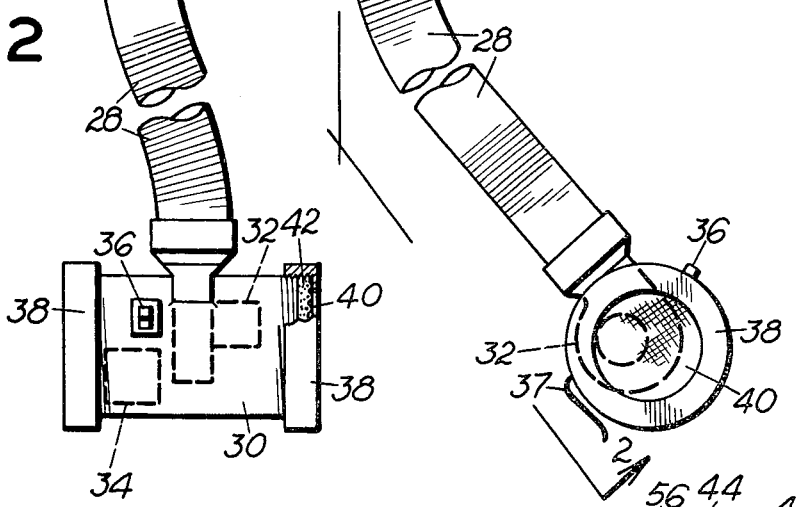
FIG. 1 is a side elevational view of a portable air filtering device for face masks embodying principles of the present invention.
Figure 3:
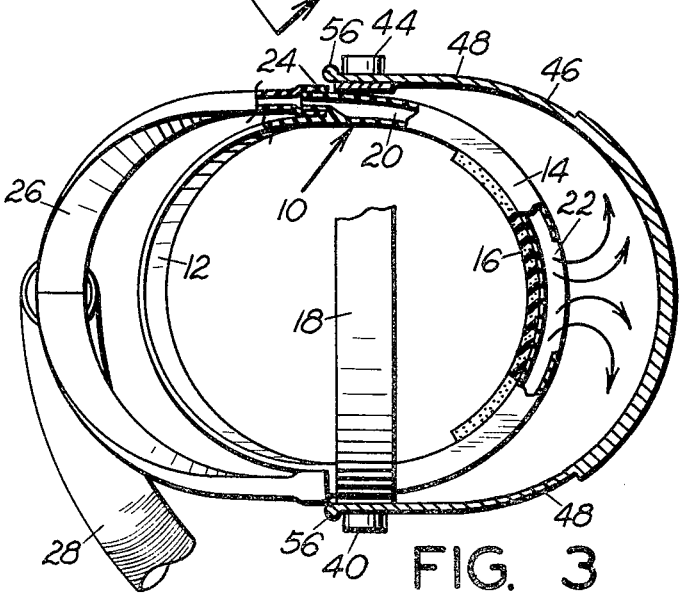
FIG. 3 is a sectional view taken on the line 3—3 of FIG. 1.

With particular reference to the drawings, and first to FIGS. 1-3, a first concept of the invention comprises a head band member 10 having a rear arcuate portion 12 arranged to engage the back of the head and a front arcuate portion 14 arranged to engage the front of the head. Arcuate portion 14 or rear arcuate portion 12, or both, are preferably formed from a resilient or stretchable material which provides a good fit and adjustment on the head. An inner lining 16 may be used if desired. The head band includes a lateral strap 18 which fits over the top of the head. This strap as well as the head band may have conventional size adjustment means, not shown, if desired.

Front portion 14 is hollow and forms a passageway 20 for the flow of filtered air. An outlet 22 for such passageway is in the upright front wall of the portion 14.

Head band portion 14 is provided with side extensions 24 having a telescoping connection with upper ends of a Y-shaped manifold 26 connected to a flexible conduit 28. Conduit 28 connects into a filter blower unit housing 30 in which is incorporated a blower 32, a battery pack 34, and suitable conventional circuitry including an on-off switch 36. Housing 30 has suitable means for support on the body of the user in a convenient position and for this purpose may include a clip 37 for engagement with the user's belt.

Opposite ends of the housing have caps 38 threadedly mounted thereon, and such caps have an apertured or mesh wall 40 allowing for the entrance of air to be filtered. Each cap 38 removably holds a filter disc 42 therein for filtering the air to be supplied to the head band. These filters are easily replaced by unthreaded displacement of the caps 38. The threaded ends of the housing 30 are of the same size and thread structure as that used on conventional respirator face masks so that existing caps for such respirator face masks can be employed for the caps 38 and the filters may comprise conventional disc-type filters now used on existing face masks. The conduit 28 allows the filters to be located at a point remote from the face of the user, and the filters are thus remote from the worst point of pollution since the latter point is usually adjacent to the head.

The head band 10 has side connections 44 of conventional design for removably receiving a face piece such as a safety mask or shield 46. The connections 44 similarly have conventional means for holding the mask vertically or in a position pivoted up away from the face. Such connecting structure is well known in the art and is not detailed.

In the operation of the arrangement of FIGS. 1-3, forced air from the blower 32 enters through the apertured caps 38 and filters 42 and is forcefully ejected through the opening 22. Since the air is ejected perpendicularly against the mask, it diffuses in all directions and discharges evenly around the open spaces between the mask and the user's head. Since the air is diffused evenly in all directions, an air barrier is provided around the entire mask and thus no polluted air is drawn in through spaces around the mask.

Any type of safety mask can thus be mounted on the head band and a consumer can apply the type of mask which accommodates a specific purpose. For best operation of the invention, it is desired that the safety mask 46 have rearwardly turned portions 48 at the sides, a rearwardly turned portion 50 at the top, and a rearwardly turned portion 52 at the bottom. Such mask structure provides a substantially equal distribution of air around the face of the user to maintain filtered air in such face area at all times.

The mask 46 preferably has cut back portions 54 on the sides to allow the user to turn his head and furthermore has a bead 56 around the rearward edges for securement to a head cover, hood, or the like.

Figure 4:
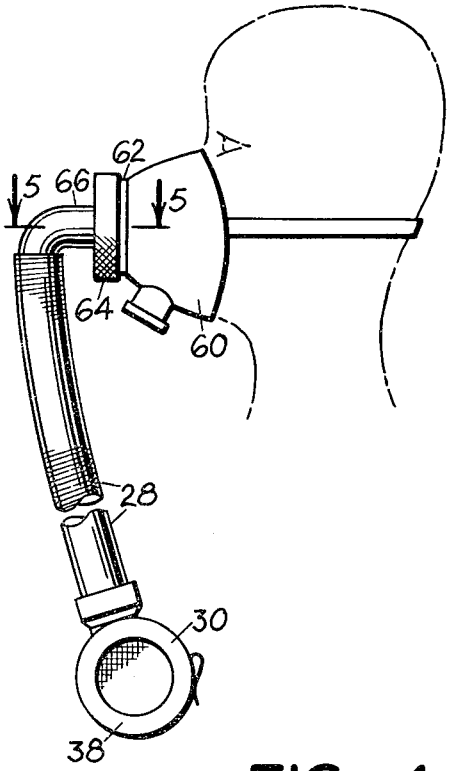
FIG. 4 is a side elevational view of another application of the present invention.
Figure 5:
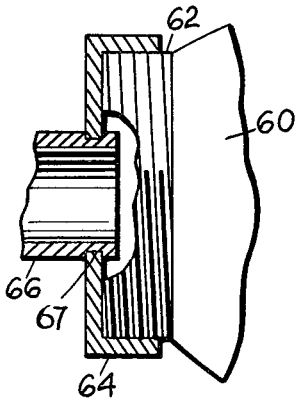
FIG. 5 is an enlarged sectional view taken on the line 5—5 of FIG. 4.

Another concept of the invention comprises the use of the filter blower unit 30 with a face piece such as a respirator face mask 60, FIGS. 4 and 5, such unit 30 using a blower 32, caps 38, filters 42, etc. the same as in FIG. 2. Mask 60 is of conventional construction and fits in an air tight connection around the nose and mouth of the wearer. This type of mask has a front threaded projection 62 arranged to receive a cap 64. In the conventional arrangement and use of such a mask, the cap used therewith is similar to cap 38 in FIG. 2, houses a filter disc the same as filter disc 42. In the concept of the present invention, however, a filter disc is not used in cap 64 since the air is already filtered in the filter blower unit 30, although of course an additional filter may if desired be used in the mask.

Instead of using a conventional cap, the cap 64 comprises an adapter cap arranged for threaded connection on the projection 62 of the conventional mask and having a pipe elbow 66 arranged at one end for plug-in connection with the hose 28. The other end of elbow 66 has a swivel connection 67 with the cap 64. Thus, not only does a concept of the invention have means for supplying a fresh layer of air across a person's face as in FIG. 1 but such fresh air could be supplied to a respirator face mask as in FIG. 4.

Figure 6:
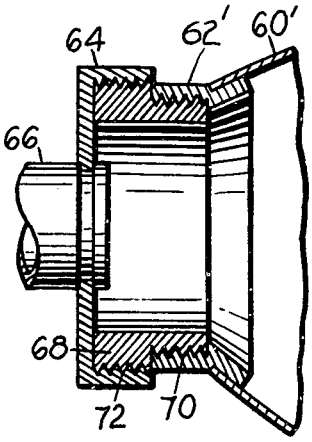
FIG. 6 is a sectional view of adapter means providing use of the invention in the manner shown in FIG. 4 but with a different form of face mask.

In some conventional face masks 60', FIG. 6, the projection 62' has internal threads, and in order to apply the present invention to such structure, an adapter ring 68 is employed having a pair of external threaded portions 70 and 72, the threaded portion 70 being of a structure to fit the internal threads of projection 62' and the threaded portion 72 being of a structure to fit the internal threads of a cap 64 having the same structure as the cap 64 in FIGS. 4 and 5. Thus, the filter blower unit can be applied to respirator face masks with internal threads at the front.

Figure 7:
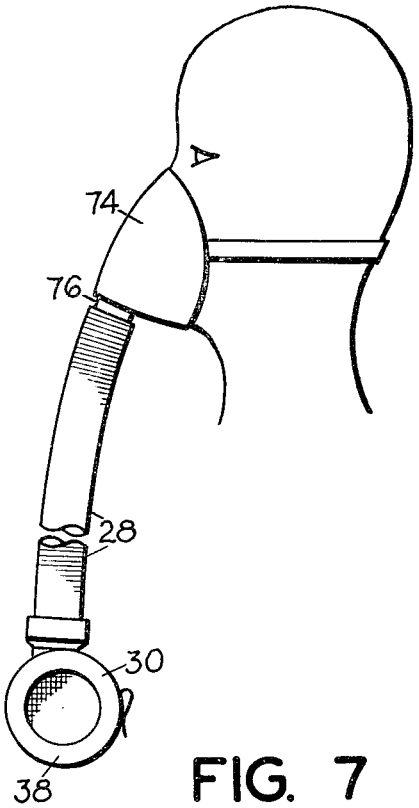
FIG. 7 is a side elevational view of still another application of the present invention.

A concept of the invention also can be associated with an oxygen-type mask 74, FIG. 7. Such type of mask fits around the nose and mouth of a wearer but as distinguished from the mask 60 in FIG. 4, no means for holding a filter is employed. The hose 28 of the filter blower unit 30 is fitted onto a connector 76 that forms a part of the mask and which in conventional use is connected to an oxygen line.

According to the present invention, filtering means is provided which can be used with substantially any type of face mask. By the specific arrangement of air ejection from the head band in the concept of FIG. 1, an air barrier is provided around the user's face which, while allowing the safety mask or shield to be suitably spaced from the face prevents any entrance of polluted air around the mask. Furthermore, since the air is ejected straight out and diffused, there are no uncomfortable currents of air flowing past the face. Another feature of the present invention is that it uses conventional on the market filters 42 so that special filters do not have to be purchased.

It is to be understood that the forms of our invention herein shown and described are to be taken as preferred examples of the same and that various changes in the shape, size and arrangement of parts may be resorted to without departing from the spirit of our invention or the scope of the subjoined claims.

Having thus described our invention, we claim:

1. A portable air filtering and breathing assist device comprising (a) a housing having at least one threaded open end,
(b) perforated threaded cap means removably mounted on the open end of said housing,
(c) filter disc means removably mounted in said cap means,
(d) an outlet on said housing,
(e) a flexible hose having one end connected to said outlet,
(f) power means in said housing,
(g) a blower in said housing driven by said power means,
(h) means in said housing establishing communication of said blower with said perforated cap means and with said outlet whereby said blower is arranged to draw in air to be filtered through said perforated cap means and discharge it out said outlet,
(i) means on said housing arranged to attach it to the body of a person in spaced relation from the head,
(j) a face mask adapted to be worn by a person,
(k) and means on said flexible hose arranged to removably attach the other end thereof to said face mask,
(l) said hose being of a length to extend from such a face mask to the housing when worn by a person at a place spaced from the head,
(m) said respirator mask having an internally threaded front projection and a hollow adapter member with first and second exterior threaded portions, the said first threaded portion being threadedly engaged with said projection, and a threaded cap removably mounted on said projection, said means removably attaching said other end of said flexible hose to the mask including an elbow portion having a swivel connection to said threaded cap and a removable connection to said flexible hose.

2. A portable air filtering and breathing assist device comprising (a) a tubular housing having opposite threaded open ends,
(b) perforated cap means threadedly mounted on the open ends of said housing,
(c) means in said cap means arranged removably to receive filter discs,
(d) an outlet on said housing,
(e) a flexible hose having one end connected to said outlet,
(f) power means in said housing,
(g) a blower in said housing driven by said power means,
(h) means in said housing establishing communication of said blower with said perforated cap means and with said outlet whereby said blower is arranged to draw in air to be filtered through said perforated cap means and discharge it out said outlet, (i) means on said housing arranged to attach it to the body of a person in spaced relation from the head, (j) a face piece adapted to be worn by a person, (k) a threaded front projection on said face piece and a threaded cap removably mounted on said projection, (i) and means on said flexible hose arranged to removably attach the other end thereof to said face piece, (m) said means removably attaching said other end of said flexible hose to the face piece including an elbow portion having a swivel connection to said threaded cap and a removable connection to said flexible hose, (n) said hose being of a length to extend from such a face piece to the housing when worn by a person at a place spaced from the head.

* * * * *